US005513766A

United States Patent [19]

Ranieri et al.

[11] Patent Number: 5,513,766

[45] Date of Patent: May 7, 1996

[54] ALUMINUM ETCHING

[75] Inventors: Richard L. Ranieri, Charlotte, N.C.; Pinakin Patel, Fort Mill, S.C.

[73] Assignee: Sandoz Ltd., Basle, Switzerland

[21] Appl. No.: 158,743

[22] Filed: Nov. 30, 1993

[51] Int. Cl.[6] ..... H01L 21/00

[52] U.S. Cl. ..... 216/102; 216/100; 252/79.5

[58] Field of Search ..... 156/665, 664; 252/79.1, 79.5; 216/100, 102

[56] References Cited

U.S. PATENT DOCUMENTS

| | | | |
|---|---|---|---|
| 2,618,604 | 11/1952 | Schaeffer | 252/135 |
| 2,853,372 | 9/1958 | McDonald | 41/42 |
| 3,083,165 | 3/1963 | Carroll | 252/79.5 |
| 3,255,118 | 6/1966 | Carroll | 252/137 |
| 4,349,411 | 9/1982 | Okinaka | 156/659.1 |
| 4,853,093 | 8/1989 | Brenk et al. | 204/37.6 |

FOREIGN PATENT DOCUMENTS

| | | |
|---|---|---|
| 142569 | 7/1980 | German Dem. Rep. . |
| 62-004890 | 1/1987 | Japan . |
| 1057575 | 11/1983 | U.S.S.R. . |
| 1188222 | 1/1984 | U.S.S.R. . |
| 1497279 | 7/1989 | U.S.S.R. . |
| 1678901 | 9/1991 | U.S.S.R. . |
| 913343 | 12/1960 | United Kingdom . |
| 1420920 | 12/1971 | United Kingdom . |
| 2254622 | 10/1992 | United Kingdom . |
| WO92/03595 | 3/1992 | WIPO . |

OTHER PUBLICATIONS

"A Long Lasting Aluminum Etching Bath", H. V. Smith, J. W. Carroll, Plating, vol. 59, No. 12, Dec., 1972, pp. 1158–1162.

PCT Search Report for PCT/EP 94/03961 dated 16, Jan. 1995.

Derwent Abstracts of: SU 1057575; SU 1188222; SU 1678901.

*Primary Examiner*—R. Bruce Breneman
*Assistant Examiner*—George Goudreau
*Attorney, Agent, or Firm*—Robert S. Honor; Carl W. Battle; Hesna J. Pfeiffer

[57] ABSTRACT

Improvements in the etching of aluminum and aluminum alloys is obtained by etching the workpiece in a caustic etching bath in the presence of an anionic surfactant of the sulfate or sulfonate type. Satisfactory results are achieved with reduced amounts of dissolved aluminum.

4 Claims, No Drawings

ALUMINUM ETCHING

BACKGROUND OF THE INVENTION

The present invention is directed to improved processes and baths for the etching of aluminum and/or aluminum alloys.

DESCRIPTION OF THE PRIOR ART

The well known physical properties of aluminum and aluminum alloys have made these materials ones of choice in the fabrication of many articles. In the production of many articles, it is frequently desirable to modify the appearance of the article, for example to provide a particular color to the article, or to increase or lower the surface reflectivity thereof. As is known to the art, modifications of the color of an aluminum and/or aluminum alloy may be obtained by treating the article in a coloring bath which includes an organic or inorganic coloring agent. Modifications in the surface appearance of aluminum and aluminum alloy articles may be attained by mechanical treatment processes, i.e., buffing or polishing, as well as by chemical treatment processes, i.e., etching in a suitable etching bath. Etching and buffing both reduce the surface reflectivity of an article, but etching processes are frequently preferred as they are significantly less labor intensive and as the article is generally immersed in an etching bath, a uniform surface appearance is obtained. However, it is also known in the art that the accumulation of etched aluminum due to dissolution of surface aluminum in the etching bath is an undesirable waste product. Understandably, there remains a continuing need in the art for improved processes for etching aluminum and aluminum alloy articles which exhibit reduced rates of accumulation of aluminum in the etching bath while providing the articles with a desirable surface appearance.

SUMMARY OF THE INVENTION

In accordance with the present invention, it has been found that the etching of aluminum and aluminum alloys is enhanced by etching in a caustic etching bath which contains an anionic surfactant of the sulfate or sulfonate type. Surprisingly, the presence in such etching baths of an effective amount of one or more such surfactants enables targeted etching results in terms of a reduction in reflectivity or gloss to be achieved with the release of less aluminum or aluminum alloy into the bath. Of equal or greater practical benefit, the indicated surfactant types enhance the etching process such that the targeted etching effects are achieved in a shorter time period than achievable in a bath which does not contain such surfactants. Other benefits and advantages from the ability of the invention to provide the foregoing effects will be evident to those skilled in the art from the description of the invention herein.

DETAILED DESCRIPTION OF THE INVENTION

Desirable improvement in the etching of aluminum and aluminum alloys is obtained by etching the workpiece in a caustic etching bath in the presence of an anionic surfactant of the sulfate or sulfonate type. The indicated surfactants may be used in any conventional aqueous caustic etching bath which contains an alkali metal hydroxide such as sodium hydroxide or potassium hydroxide, usually sodium hydroxide. The alkali metal hydroxide may be present in such baths in a concentration of from 20 to 120 grams per liter of water, typically 40 to 90 grams per liter, and more usually 50 to 70 grams per liter. Such etching baths may also optionally contain other conventional constituents including without limitation sequestering agents, chelating agents, and the like such as sodium gluconate and sodium heptanate. Other conventional constituents include antifoaming agents.

The etching of aluminum and aluminum alloys in the improved etching baths of the invention may be carried out under conditions conventionally used in etching such workpieces in a caustic etching bath. Generally, such baths are operated at elevated temperatures which may vary generally in the range of 70° F. to 170° F., and which more usually are in the range of 125° F. to 140° F., and preferably from 130° F. to 140° F. Such processes may be operated below or above atmospheric pressure but are preferably carried out at atmospheric pressure. The time of treatment may vary depending upon known factors such as the particular workpiece, the conditions of treatments and results desired. Conventional caustic etchings may be carried out for from several minutes up to an hour or more. As indicated, the etching baths and processes of the invention are particularly useful to reduce etching times while obtaining targeted etching effects in less time than without the surfactant adjuvants of the invention. Hence, satisfactory results with the instant process may be obtained in a matter of only a few seconds, e.g., 10 seconds, up to much longer intervals, with most targeted results obtainable in no more than 40 minutes. Useful results may be generally obtained in time intervals of from as little as 10 seconds to about 30 minutes, more generally useful time ranges vary from 5 to 20 minutes, with the most usual time range being from about 8 to 15 minutes. Less free aluminum is released into the bath as waste product with the invention and it also has been observed that the process produces etched aluminum surfaces which exhibit a reduced "spangling" which is considered an undesired graininess in the etched surface encountered in conventionally etched surfaces.

Anionic surfactants of the sulfate and sulfonate type are well-known and any such surfactant may be used to enhance the etching of aluminum and aluminum alloys in accordance with the invention. Such surfactants involve a wide variety of chemical compounds generally characterized by having one or more sulfate or sulfonate groups which provide a hydrophilic portion, and which are attached to an organic portion which provides the hydrophobic properties. Such sulfates or sulfonates are present in the aqueous caustic etching baths of the invention essentially in hydrolyzed form or hydrolyzed salt form which may be provided using surfactants in any water hydrolyzable or any water-soluble form including without limitation salt forms such as the alkali metal and various ammonium salt forms such as sodium, potassium, ammonium, alkylammonium and alkanol-ammonium salt forms. The etching baths of the invention may be formed by simple mixing of the one or more anionic surfactants in salt form with the water of the bath before, during or after addition of the caustic alkali to the bath water. The anionic surfactant compounds useful in the invention may exist in free acid and ester forms and several such compounds are available commercially. Such acid and ester compounds may be used to form in situ the desired salts in the etching baths of the invention by simple mixing of the acid or ester forms with the caustic etching bath whereby the acid forms are neutralized and the ester forms hydrolyzed to a desired salt form, e.g., the sodium salt form. If desired, additional alkali may be added to the baths to make up for the relatively small amount of alkali lost in such conversion reactions. The anionic sulfate and sulfonate surfactants in salt form will be present in the etching bath in an amount sufficient to enhance the etching of the aluminum or aluminum alloy workpiece. Such positive effects may be obtained in baths containing as little as at least about 0.1% by weight of surfactant based on the weight of water in the bath. The amount of surfactant may range up to 2.0% by weight of the bath water or more, but as a practical matter such greater amounts are indicated to offer little or no increased benefit. Preferably, the amount of surfactant will range from 0.2% to 1.0% by weight of the bath water, more preferably from 0.3% to 0.8%. The benefits obtained from the use of such small amounts of such surfactants make the instant invention particularly advantageous.

As indicated, any anionic surfactant of the sulfate and sulfonate type may be used in the practice of the present invention. The compounds of the following structural formulae I, II, III, IV, V, VI and VII are merely representative of the more well-known or preferred sulfate and sulfonate anionic surfactants which may be used in the invention, and the identification of such compounds should not be taken in any way as restricting the sulfate and sulfonate surfactants which are useful in practicing the invention.

Hence, one such known class of surfactants includes sulfates and sulfonates and is represented by the compounds of the formula I:

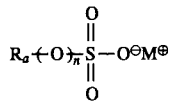

[I]

wherein;

n is 0 or 1, $R_a$ is $C_{8-25}$alkyl which may be optionally substituted by one or more groups selected from the group consisting of halo, alkoxy, hydroxy, mercapto, amino or di($C_{1-5}$alkyl)amino, $C_{1-5}$alkanol, $C_{1-5}$alkanoylamino, carbamoyl and sulfamoyl and which may optionally contain (be interrupted by) one or more moieties selected from the group consisting of oxy, thio, keto, sufinyl and sulfonyl, and, M is a salt forming cation of an alkali metal or alkaline earth metal or an ammonium ion or an alkyl- or alkanol-ammonium cation such as mono-, di- or tri-alkyl ammonium cation.

Another representative groups of surfactants are represented by structural formula II:

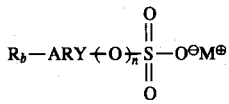

[II]

where;

n is 0 or 1, $R_b$ is $C_{4-24}$alkyl which may be optionally substituted or interrupted in the manner described for $R_a$ as above defined, ARY is a phenyl or naphthalene moiety optionally substituted by one or more groups selected from the group consisting of alkyl, alkoxy, halo and hydroxy, and, M is as above defined.

A further class of such known surfactants is represented by the compound of the formula III:

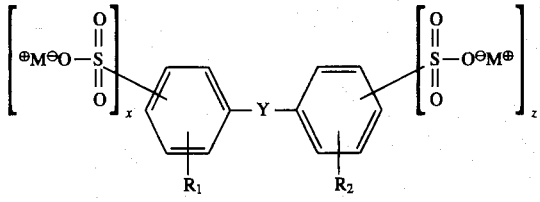

[III]

wherein

Y is a direct bond, —$CH_2$—, —O—, —S—, —SO—, —$SO_2$— or —$C(CH_3)_2$—, $R_1$ and $R_2$ are each independently H or $C_{6-25}$alkyl which may be optionally substituted or interrupted as defined with reference to $R_a$ above provided that $R_1$ and $R_2$ may not both be H, x and z may be 0 or an integer from 1 to 2 with the proviso that at least one of x or z is an integer from 1 to 2, and M is as defined above.

Other suitable anionic surfactants are represented by the following structural formula IV:

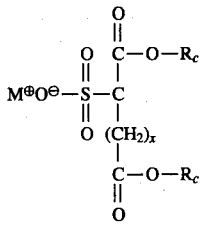

[IV]

wherein each $R_c$ is independently $C_{1-10}$alkyl optionally substituted by halo, alkoxy, hydroxy, mercapto, amino and mono- or di-($C_{1-5}$alkyl)amino, x is 0 or an integer from 1 to 15, preferably 1 to 5 and more preferably 1; and M is as above defined.

Another grouping of the indicated surfactants is represented by formula V,

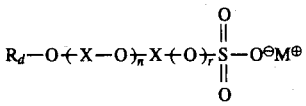

[V]

wherein n is an integer from 2 to 20, preferably from 3–15, r is 0 or 1,

X is —$CH_2CH_2$— or —$CH_2CH(CH_3)$— or a mixture thereof, $R_d$ is $R_a$ or $R_b$-ARY- as above defined, and M is as above defined.

A still further grouping of the indicated surfactants is represented by the structural formula VI:

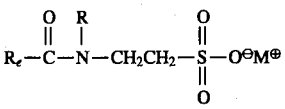

[VI]

wherein $R_e$ is $R_a$ or $R_b$-ARY- as above defined, each R is independently H or $R_a$ as above defined, and M is as above defined.

A still further grouping of the indicated surfactants is represented by the structural formula VI:

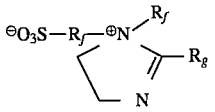

[VII]

wherein each $R_f$ independently is $C_{2-8}$alkyl which may be optionally substituted by one or more groups selected from the group consisting of halo, alkoxy, hydroxy, mercapto, amino, mono- or di-($C_{1-5}$alkyl)amino, $C_{1-5}$alkanol, $C_{1-5}$alkanoylamino, carbamoyl and sulfamoyl and which may optionally contain (be interrupted by) one or more moieties selected from the group consisting of alkenyl, oxy, thio, keto, sufinyl and sulfonyl, $R_g$ is $C_{2-25}$alkyl which be be substituted or interruped in the manner described above in reference to $R_f$.

EXAMPLES

To clearly demonstrate the present invention, various comparative and illustrative examples were produced. All of the examples were performed using aluminum samples having approximate physical dimensions of 2 inches by 3 inches by ⅛th inches of an aluminum alloy (Alloy 5005; approx. 95% Al, 5% other metals) which had been degreased and cleaned, dried and accurately weighed. The weight loss was determined from the difference in a sample's weight before and after the etching process, which result was used to report the amount of aluminum lost as well as the percentage weight loss. The surface gloss readings were determined by the use of a Paul N. Gardner & Co., Inc. Glossgard II 20° Glossmeter, which reported the surface gloss readings in dimensionless units. Generally, surface gloss readings of approximately "15" and less are commerically desirable.

Comparative Example 1

A 500 ml aqueous etch bath was formed by adding to the water 12.5 grams of sodium hydroxide, which was then heated to 125° F. Once this temperature was reached, an aluminum sample was totally immersed in the bath for 10 minutes during which time the bath temperature was maintained. Afterwards, the sample was removed, rinsed with tap water, briefly immersed in a conventional deoxidizing bath to deoxidize the sample, and then rinsed again with tap water. The sample was then dried and weighed. The sample was observed to lose 0.31 grams, which was determined to be a 3.7% weight loss. The sample was then evaluated using the Glossgard II 20° Glossmeter, which indicated a surface gloss reading of "31".

Comparative Example 2

A 500 ml aqueous bath was produced in accordance to Comparative Example 1, and an aluminum sample was subjected to the same process as therein described. Evaluation of the sample indicated a loss of 0.33 grams, a 3.8% weight loss, and a surface gloss reading of "32" was obtained.

Comparative Example 3

A 500 ml aqueous etch bath was formed by adding to the water 12.5 grams of sodium hydroxide and 6 grams of a commercially available inorganic oxidation accelerator, and subsequently heating the bath to 125° F. Once this temperature was reached, an aluminum sample was totally immersed in the bath for 10 minutes during which time the bath temperature was maintained. Afterwards, the sample was removed, rinsed with tap water, briefly immersed in a conventional deoxidizing bath to deoxidize the sample, and then rinsed again with tap water. The sample was then dried and weighed. The sample was observed to lose 0.59 grams, a 7.1% weight loss. A surface gloss reading of "7" was obtained.

Comparative Example 4

A 500 ml aqueous bath was produced in accordance to Comparative Example 3, and a further sample was subjected to the same etching process as therein described. Evaluation of this further sample revealed a weight loss of 0.59 grams, a 7.1% weight loss, and a surface gloss reading of "7".

Example 5

A 500 ml aqueous etch bath was formed by adding to the water 12.5 grams of sodium hydroxide, 2.1 grams of an alkyl substituted diphenyl-ether group-containing surfactant composition according to formula III, more particularly a mixture of surfactants compositions according to the formulae:

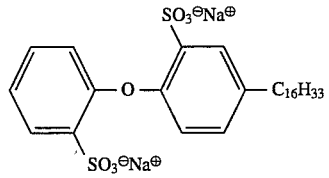

and

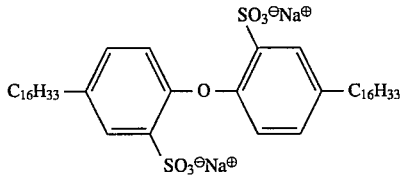

and 4 grams of a conventional defoaming agent, Surfynol 104PG 50 (Air Products Corp., Allentown, Pa.) to control foaming of the etching bath. The bath was subsequently heated to 125° F., at which point an aluminum sample was totally immersed in the bath for 10 minutes during which time the bath temperature was maintained. The sample was rinsed with tap water, briefly immersed in a conventional deoxidizing bath to deoxidize the sample, and then rinsed again with tap water. The sample was then dried and weighed. The sample was observed to lose 0.28 grams, a 3.4% loss in weight. A surface gloss reading of "6" was measured.

Example 6

A 500 ml aqueous bath was produced in accordance to Example 5, and a further aluminum sample was subjected to the same etching process as therein described. Evaluation of this sample revealed a loss of 0.28 grams, a 3.4% loss in weight, and a surface gloss reading of "6".

Example 7

A 500 ml aqueous etch bath was formed by adding to the water 12.5 grams of sodium hydroxide, and 2.8 grams of a surfactant composition according to the following structure:

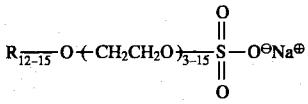

where R is a $C_{12-15}$ straight chain alkyl moiety. The bath was subsequently heated to 125° F., at which point an aluminum sample was totally immersed in the bath for 10 minutes during which time the bath temperature was maintained. The sample was rinsed with tap water, briefly immersed in a conventional deoxidizing bath to deoxidize the sample, and then rinsed again with tap water. The sample was then dried and weighed. The sample was observed to lose 0.31 grams, a weight loss of 3.8%. A surface gloss reading of "16" was measured.

Example 8

A 500 ml aqueous bath was produced in accordance to Example 7, and a further aluminum sample was subjected to the same etching process as therein described. Evaluation of this sample exhibited a loss of 0.30 grams, a weight loss of 3.6% and a surface gloss reading of "16".

Example 9

A 500 ml aqueous etch bath was formed by adding to the water 12.5 grams of sodium hydroxide, and 2.0 grams of a surfactant composition according to the following structure:

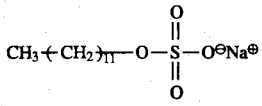

The bath was subsequently heated to 125° F., at which point an aluminum sample was totally immersed in the bath for 10 minutes during which time the bath temperature was maintained. The sample was rinsed with tap water, briefly immersed in a conventional deoxidizing bath to deoxidize the sample, and then rinsed again with tap water. The sample was then dried and weighed. The sample was observed to lose 0.33 grams, a weight loss of 3.1%. A surface gloss reading of "18" was measured.

Example 10

A 500 ml aqueous bath was produced in accordance to Example 9, and a further aluminum sample was subjected to the same etching process as therein described. Evaluation of this sample revealed a loss of 0.34 grams, a weight loss of 3.2%, and a surface gloss reading of "16".

Example 11

A 500 ml aqueous etch bath was formed by adding to the water 12.5 grams of sodium hydroxide, and 4.0 grams of a $C_{12}$alkylaryl group containing surfactant composition according to the following structure:

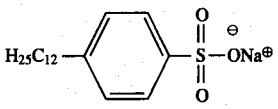

The bath was subsequently heated to 125° F., at which point an aluminum sample was totally immersed in the bath for 10 minutes during which time the bath temperature was maintained. The sample was rinsed with tap water, briefly immersed in a conventional deoxidizing bath to deoxidize the sample, and then rinsed again with tap water. The sample was then dried and weighed. The sample was observed to lose 0.43 grams, a weight loss of 4.1%. A surface gloss reading of "10" was measured.

Example 12

A 500 ml aqueous bath was produced in accordance to Example 7, and a further aluminum sample was subjected to the same etching process as therein described. Evaluation of this sample revealed a loss of 0.43 grams, a weight loss of 4.1%, and a surface gloss reading of "9".

Example 13

A 500 ml aqueous etch bath was formed by adding to the water 12.5 grams of sodium hydroxide, 8.0 grams of an imidazolyl surfactant composition according to following formula:

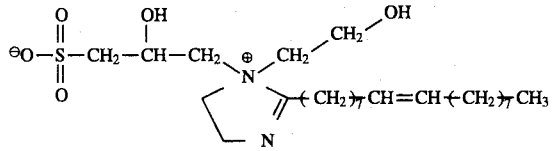

The bath was subsequently heated to 125° F., at which point an aluminum sample was totally immersed in the bath for 10 minutes during which time the bath temperature was maintained. The sample was rinsed with tap water, briefly immersed in a conventional deoxidizing bath to deoxidize the sample, and then rinsed again with tap water. The sample was then dried and weighed. The sample was observed to lose 0.24 grams, a 2.2% loss in weight. A surface gloss reading of "13" was measured.

Example 14

A similar 500 ml aqueous bath was produced in accordance to Example 13 using 4.0 grams of the imidazoyl surfactant, and a further aluminum sample was subjected to the same etching process as therein described. Evaluation of this sample revealed a loss of 0.28 grams, a 2.7% loss in weight, and a surface gloss reading of "14".

It will be appreciated that the instant specifications and examples set forth herein are by way of illustration and not limitation, and that various modifications and changes may be made without departing from the spirit and scope of the present invention. For example, the etching baths as taught herein and their use may be used to re-etch previously etched aluminum and aluminum alloy articles. Such articles may have been etched by an etching process which is the same as, or different than, the process being taught herein. Further, the etching baths and processes according to the present invention may be used before or after other aluminum process steps, including cleaning, etching, anodizing, coloring and sealing treatment steps. Accordingly, the limitations of the use of the invention are imposed only by the appendant claims.

We claim:

1. A process for etching an aluminum or aluminum alloy article comprising: treating the article in a caustic alkali metal hydroxide etching bath at a caustic concentrate of 20–120 grams per liter and a temperature of 70°–170° F., said etching bath also containing 0.1–2.0% by weight of an anionic surfactant of the sulfate or sulfonate type according to the formula:

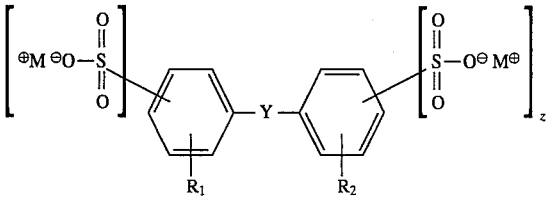

wherein

Y is a direct bond, —$CH_2$—, —O—, —S—, —SO—, —$SO_2$— or —$C(CH_3)_2$—; $R_1$ and $R_2$ are each independently H or $C_{6-25}$alkyl which may be optionally substituted by one or more groups selected from the group consisting of halo, alkoxy, hydroxy, mercapto, amino or di($C_{1-5}$alkyl)amino, $C_{1-5}$alkanol, $C_{1-5}$alkanoylamino, carbamoyl and sulfamoyl and which may be optionally contain one or more moieties selected from the group consisting of oxy, thio, keto, sufinyl and sulfonyl, and may be linear or branched provided that $R_1$ and $R_2$ may not both be H;

z is 0 or 1; and

M is a salt forming cation of an alkali metal ion.

2. The process of claim 1 wherein the alkali metal hydroxide is sodium hydroxide.

3. The process of claim 2 wherein M is sodium.

4. A process for etching an aluminum or aluminum alloy article comprising: contacting the article with a caustic alkali metal hydroxide etching bath at a caustic concentration of 20–120 grams per liter and a temperature of 70°–170° F. said etching bath also containing 0.1–2.0% by weight at least one anionic surfactant according to the formula:

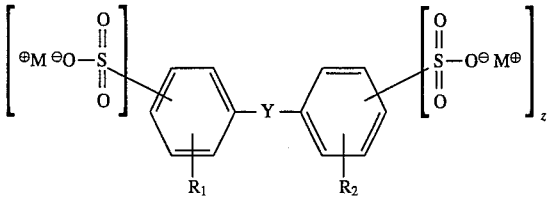

wherein

Y is a direct bond, —$CH_2$—, —O—, —S—, —$SO_2$— or —$C(CH_3)_2$—, $R_1$ and $R_2$ are each independently H or $C_{6-25}$alkyl which may be optionally substituted by one or more groups selected from the group consisting of halo, alkoxy, hydroxy, mercapto, amino or di($C_{1-5}$alkyl)amino, $C_{1-5}$alkanol, $C_{1-5}$alkanoylamino, carbamoyl and sulfamoyl and which may optionally contain one or more moieties selected from the group consisting of oxy, thio, keto, sufinyl and sulfonyl and may be linear or branched provided that $R_1$ and $R_2$ may not both be H;

z is 0 or 1; and

M is a salt forming cation of an alkali metal ion;

optionally, rinsing the etched portions of the article with a rinsing fluid;

subsequently, contacting the etched portions of the article with a deoxidizing bath; and optionally, subsequently rinsing the etched portions of the article with a rinsing fluid.

* * * * *